US008983332B2

(12) United States Patent
Horie et al.

(10) Patent No.: US 8,983,332 B2
(45) Date of Patent: Mar. 17, 2015

(54) IMAGE FORMING APPARATUS AND METHOD OF CONTROLLING THE SAME

(71) Applicants: Takayuki Horie, Toyokawa (JP); Hideaki Hayashi, Toyokawa (JP); Masashi Saito, Hachioji (JP); Hideki Hadano, Toyokawa (JP); Osamu Morita, Toyokawa (JP); Satoru Yoneda, Toyohashi (JP)

(72) Inventors: Takayuki Horie, Toyokawa (JP); Hideaki Hayashi, Toyokawa (JP); Masashi Saito, Hachioji (JP); Hideki Hadano, Toyokawa (JP); Osamu Morita, Toyokawa (JP); Satoru Yoneda, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 16 days.

(21) Appl. No.: 13/836,197

(22) Filed: Mar. 15, 2013

(65) Prior Publication Data

US 2013/0243453 A1 Sep. 19, 2013

(30) Foreign Application Priority Data

Mar. 19, 2012 (JP) ..... 2012-062032

(51) Int. Cl.
*G03G 15/00* (2006.01)
*G03G 15/20* (2006.01)
*G03G 21/20* (2006.01)

(52) U.S. Cl.
CPC ..... *G03G 21/20* (2013.01); *G03G 21/206* (2013.01)
USPC ..... 399/93; 399/67; 399/98

(58) Field of Classification Search
CPC ..... G03G 15/00; G03G 15/20; G03G 21/00; G03G 21/20; G03G 21/06
USPC ..... 399/92, 93, 98, 67
See application file for complete search history.

(56) References Cited

U.S. PATENT DOCUMENTS

| | | | |
|---|---|---|---|
| 2011/0211859 A1 | 9/2011 | Shimoyama et al. | |
| 2011/0211860 A1 | 9/2011 | Shimoyama et al. | |

FOREIGN PATENT DOCUMENTS

| | | | |
|---|---|---|---|
| JP | 07-168515 A | | 7/1995 |
| JP | 10-143054 A | | 5/1998 |
| JP | 2003-162165 A | * | 6/2003 |
| JP | 2003-291458 A | | 10/2003 |
| JP | 2007-304132 A | | 11/2007 |
| JP | 2009-098189 A | | 5/2009 |
| JP | 2009-265280 A | | 11/2009 |

(Continued)

OTHER PUBLICATIONS

Office Action (Decision to Grant Patent) issued on Feb. 4, 2014, by the Japanese Patent Office in corresponding Japanese Patent Application No. 2012-062032, and an English Translation of the Office Action.(6 pages).

(Continued)

*Primary Examiner* — Sophia S Chen
(74) *Attorney, Agent, or Firm* — Buchanan Ingersoll & Rooney PC

(57) ABSTRACT

An image forming apparatus has an outline surrounded by a casing. The casing has an opening. The image forming apparatus includes a fixing unit configured to fix an image formed on a recording medium, and a control unit. The fixing unit includes a heating fixing member. The control unit is configured to control an opening degree of the opening based on temperature of a surface of or in the vicinity of the heating fixing member, so as to prevent emission of a substance by an air current to outside of the casing through the opening, during an image forming operation.

8 Claims, 11 Drawing Sheets

(56) References Cited

FOREIGN PATENT DOCUMENTS

| | | | |
|---|---|---|---|
| JP | 2010-002803 | A | 1/2010 |
| JP | 2011-180235 | A | 9/2011 |
| JP | 2011-180236 | A | 9/2011 |
| JP | 2011-180340 | A | 9/2011 |
| JP | 2011-180341 | A | 9/2011 |

OTHER PUBLICATIONS

Office Action (Decision to Grant Patent) issued on Feb. 4, 2014, by the Japanese Patent Office in corresponding Japanese Patent Application No. 2012-062032, and an English Translation of the Office Action. (6 pages).

* cited by examiner

IMAGE FORMING APPARATUS AND METHOD OF CONTROLLING THE SAME

This application is based on Japanese Patent Application No. 2012-62032 filed with the Japan Patent Office on Mar. 19, 2012, the entire content of which is hereby incorporated by reference.

BACKGROUND OF THE INVENTION

1. Field of the Invention

The present disclosure relates to an image forming apparatus and a method of controlling the same, and particularly to an image forming apparatus including a fixing unit for fixing a toner image on a recording medium and a method of controlling the same.

2. Description of the Related Art

Various techniques have been conventionally studied to avoid emissions of ozone, toner dust and the like generated in an electrophotographic image forming apparatus to the outside of the apparatus.

It has been discovered in recent years that not only ozone and toner dust, but also ultra fine particles (hereinafter also referred to as "UFP" when appropriate) having a particle size of 100 nm or less are generated in such image forming apparatus. A technique of suppressing UFP emissions to the outside of an apparatus is proposed in Japanese Laid-Open Patent Publication No. 2010-002803, for example. In this document, an image forming apparatus adopts means for collecting dust electrostatically and means for suctioning dust by a cyclone.

One problem suffered by the conventional technique such as described above, however, was that the provision of the collecting means and suctioning means as described above results in increase in structural complexity and size of the apparatus.

SUMMARY OF THE INVENTION

The present disclosure has been made in view of this situation, and an object of the present disclosure is to provide an image forming apparatus capable of achieving suppressed emission of dust to the outside of the apparatus while avoiding increase in structural complexity and size of the apparatus, and a method of controlling the same.

In accordance with one aspect, an image forming apparatus having an outline surrounded by a casing, for forming an image on a recording medium, is provided. The casing has an opening. The image forming apparatus includes a fixing unit configured to fix an image formed on the recording medium. The fixing unit includes a heating fixing member. The image forming apparatus further includes a control unit configured to control an opening degree of the opening, and a first detection unit configured to detect temperature of a surface of or in the vicinity of the heating fixing member. The control unit is configured to control the opening degree of the opening based on the temperature detected by the first detection unit, so as to prevent emission of a substance by an air current to outside of the casing through the opening, during an image forming operation.

Preferably, in a case where the temperature detected by the first detection unit exceeds a first set value, the control unit is configured to reduce the opening degree of the opening compared to the opening degree when the temperature is equal to or lower than the first set value, and after the opening degree of the opening has been reduced due to the temperature detected by the first detection unit exceeding the first set value, in a case where the temperature detected by the first detection unit reaches a second set value or lower which is a value equal to or lower than the first set value, the control unit is configured to cancel the reduction of the opening degree of the opening.

Still preferably, the control unit is configured not to reduce the opening degree of the opening even in a case where the temperature detected by the first detection unit exceeds the first set value, when a particular condition is satisfied.

Still preferably, the image forming apparatus further includes a second detection unit configured to detect temperature in the vicinity of the opening, in which the particular condition is that the temperature detected by the second detection unit exceeds a particular temperature.

Still preferably, the particular condition is set based on a number of recording media on which an image is formed by the image formation unit.

Still preferably, the particular condition is set based on a period of time during which the control unit continues the reduction of the opening degree of the opening.

Preferably, the control unit is configured to reduce the opening degree of the opening until the opening is closed.

Preferably, the image forming apparatus further includes a member for varying the opening degree of the opening. The control unit is configured to control the opening degree of the opening by displacing the member. The member contains metal.

In accordance with another aspect, a method of controlling an image forming apparatus having an outline surrounded by a casing, for forming an image on a recording medium, is provided. The image forming apparatus includes a fixing unit configured to fix an image formed on the recording medium and a control unit configured to control operations of the image forming apparatus. The casing has an opening. The fixing unit includes a heating fixing member. The control method includes the steps of detecting, by the image forming apparatus, a temperature of a surface of or in the vicinity of the heating fixing member during an image forming operation, and controlling, by the image forming apparatus, an opening degree of the opening based on the temperature of a surface of or in the vicinity of the heating fixing member, so as to prevent emission of a substance by an air current to outside of the casing through the opening.

According to the present disclosure, emission of dust to the outside of the image forming apparatus can be suppressed while increase in structural complexity and size of the image forming apparatus is avoided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of an image forming apparatus will be described hereinafter with reference to the drawings. In the following description, the same components and elements are designated by the same characters, and redundant description will not be repeated.

<General Structure of Image Forming Apparatus>

Figure 1:
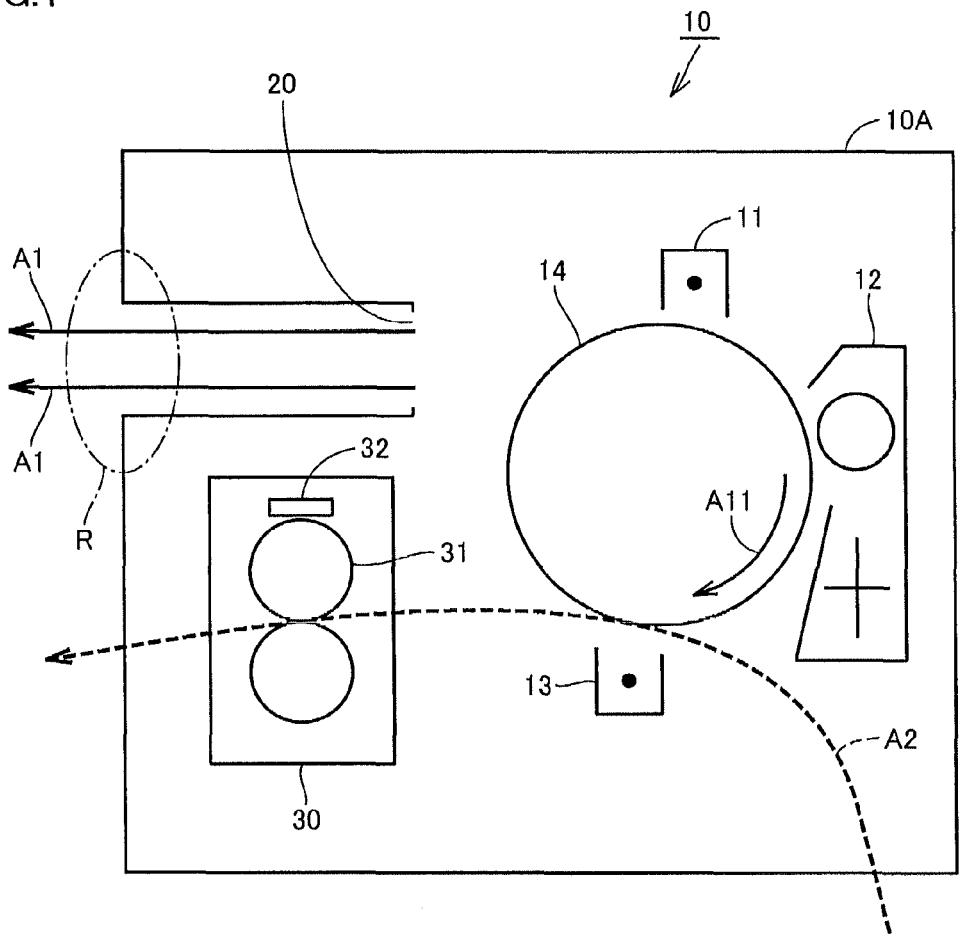
FIG. 1 is a diagram schematically showing an internal structure of a black-and-white printer in one embodiment of an image forming apparatus.

Referring to FIG. 1, a structure of an image forming apparatus is generally described. FIG. 1 is a diagram schematically showing an internal structure of a black-and-white printer (hereinafter referred to simply as "printer") in one embodiment of the image forming apparatus.

A printer 10 has an outline surrounded by a casing 10A. Casing 10A includes therein a charging device 11, a developing device 12, a transferring device 13, a photoreceptor 14, and a fixing device 30. An arrow A2 indicates a delivery path of a sheet (one example of a recording medium) on which an image is formed in printer 10.

In printer 10, charging device 11 forms an electrostatic latent image on a surface of photoreceptor 14. Photoreceptor 14 is rotated in a direction of an arrow A11 by a not-shown rotation mechanism (which is included in an image formation unit 110 to be described later). Developing device 12 supplies toner to the surface of photoreceptor 14 on which the electrostatic latent image has been formed, to form a toner image on the surface of photoreceptor 14. The sheet passes between photoreceptor 14 and transferring device 13, to transfer the toner image on the surface of photoreceptor 14 onto the sheet. An image is thus formed on the sheet. Fixing device 30 heats the sheet that has been delivered to fixing device 30, to fix the image formed on the sheet.

Fixing device 30 includes a fixing roller 31, and a temperature sensor 32 arranged in the vicinity of fixing roller 31 for detecting temperature in the vicinity of fixing roller 31. Fixing roller 31 is heated by a not-shown heater (which is included in image formation unit 110 to be described later).

Casing 10A is provided with an air discharge opening 20. A filter and a louver are provided in the vicinity of air discharge opening 20 (the portion of an ellipse R indicated by a chain-dotted line in FIG. 1), as will be described later with reference to FIG. 3. Printer 10 includes a fan (fan 160) for blowing air into casing 10A, as will be described later with reference to FIG. 2. The wind from the fan causes the air in casing 10A to be discharged through the filter and louver to the outside of casing 10A. An arrow A1 indicates a flow of air to be discharged.

<Hardware Configuration of Image Forming Apparatus>

Figure 2:
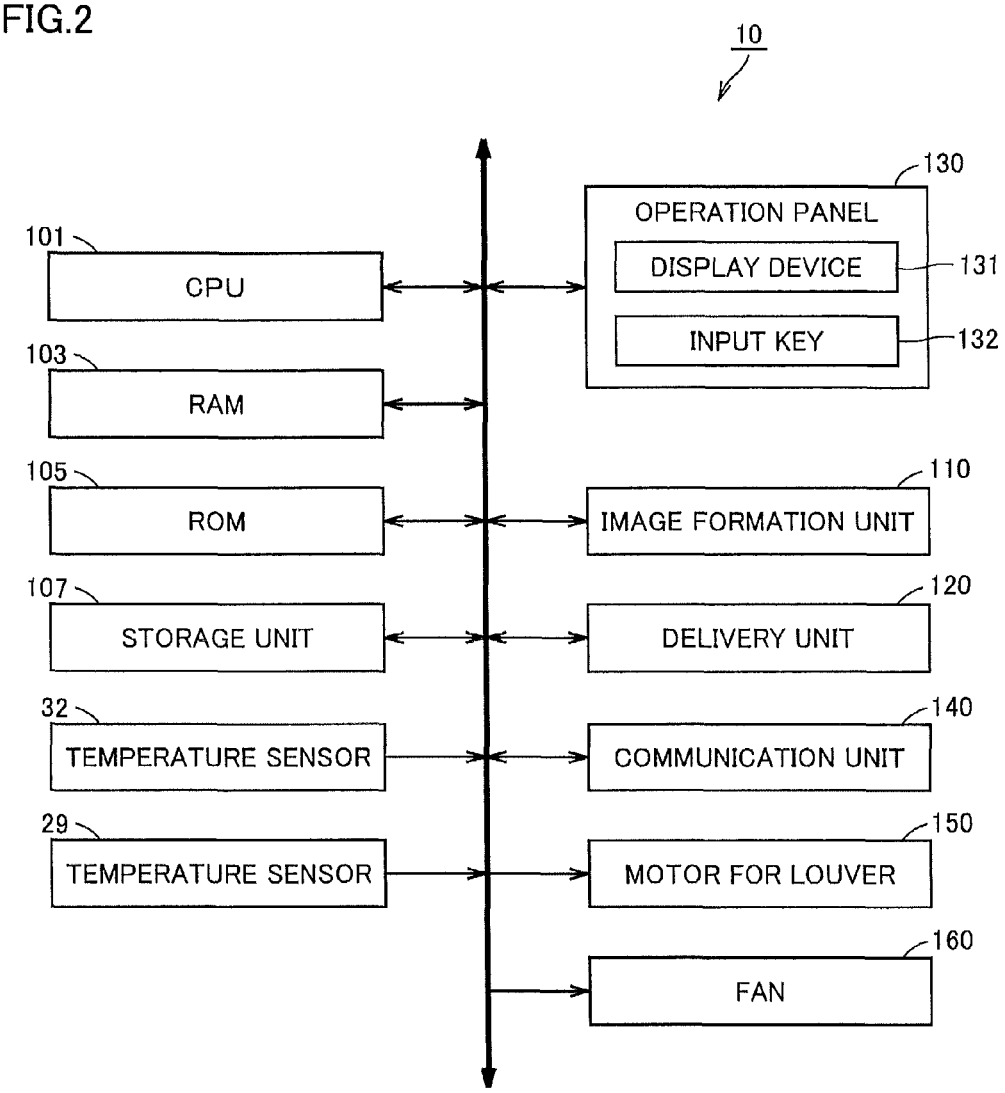
FIG. 2 is a diagram showing a hardware configuration of the printer shown in FIG. 1.

Referring to FIG. 2, an example of hardware configuration of the image forming apparatus is described. FIG. 2 is a diagram showing an example of hardware configuration of printer 10 shown in FIG. 1.

Referring to FIG. 2, printer 10 includes a CPU (Central Processing Unit) 101 for controlling the entire apparatus, a RAM (Random Access Memory) 103 for temporarily storing data, a ROM (Read Only Memory) 105 for storing a program, a constant and the like, a storage unit 107 for storing image data and the like, an operation panel 130 for receiving operations by a user, image formation unit 110 for printing image data on a sheet, a delivery unit 120 having a motor and the like for delivering the sheet in the direction of arrow A2 in printer 10, and a communication unit 140 for controlling communication between components in printer 10 and communication with equipment present outside of printer 10.

Operation panel 130 includes a display screen 131 for displaying a state of printer 10 and command options, and an input key 132 for inputting a numerical value and the like. Display screen 131 and input key 132 may be implemented as a touch panel. The touch panel includes a liquid crystal display and a touch sensor mounted thereon, for example.

Printer 10 includes temperature sensor 32, a temperature sensor 29, a motor for louver 150, and fan 160. Temperature sensor 29 detects a temperature of the louver provided in the vicinity of air discharge opening 20, as will be described later with reference to FIG. 3 and the like. Motor for louver 150 is a motor for varying an opening degree of the louver. Fan 160 is a fan for discharging the air in casing 10A to the outside, as described above.

During an image forming operation in printer 10, CPU 101 controls driving of motor for louver 150 based on the detected temperature from temperature sensor 32 and the like. As such, the opening degree of the louver is controlled based on the detected temperature from temperature sensor 32 and the like. In printer 10, the opening degree of the louver is controlled to control an opening degree of air discharge opening 20.

In this embodiment, "during an image forming operation" refers to a state where printer 10 has been turned on and is operating to form an image. That is, "during an image forming operation" includes not only a period of time during which an image is formed on a sheet that has been delivered into casing 10A in printer 10, but also a warm-up period during recovery from a sleep state or immediately after turn-on of printer 10, a period of time between completion of the image forming operation and transition to a sleep state, and the like.

<Opening/Closing of Louver>

Figure 3:
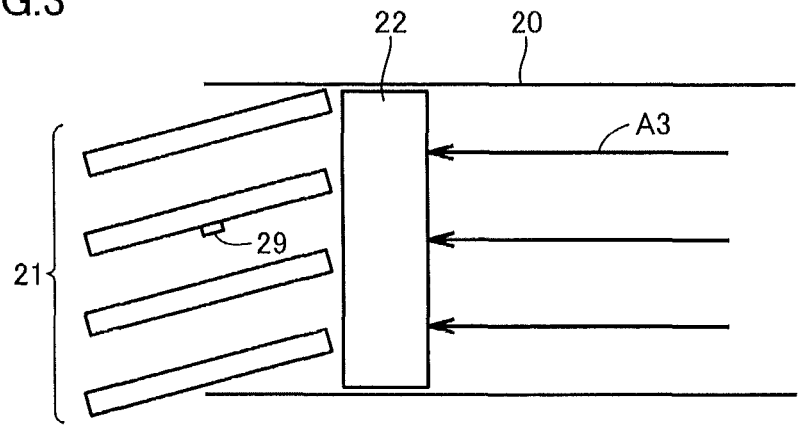
FIG. 3 is a diagram schematically showing an example of an opened/closed state of a louver.
Figure 4:
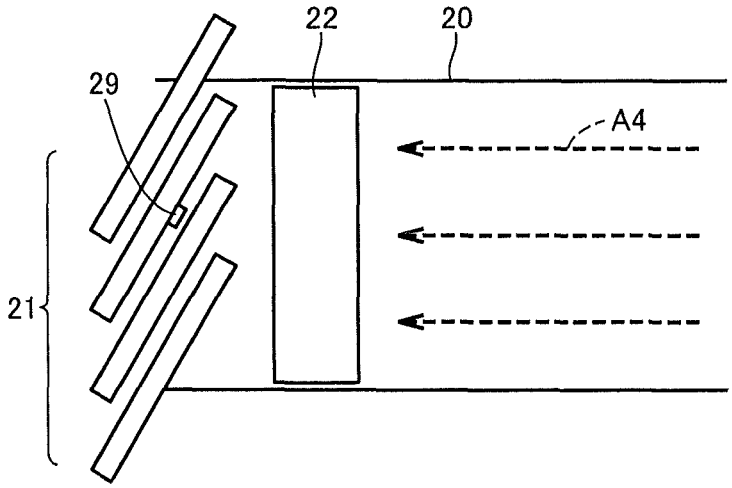
FIG. 4 is a diagram schematically showing an example of a state where an opening degree of an air discharge opening has been reduced from the state shown in FIG. 3.

As described above, in printer 10, opening/closing of the louver provided in the vicinity of air discharge opening 20 is controlled based on the temperature in the vicinity of fixing roller 31 and the like. Referring to FIGS. 3 and 4, an operation of the louver is described.

FIG. 3 is a diagram schematically showing an example of an opened/closed state of air discharge opening 20 (louver). FIG. 4 is a diagram schematically showing an example of a state where the opening degree of air discharge opening 20 (louver) has been reduced from the state shown in FIG. 3. It is noted that each of FIGS. 3 and 4 corresponds to an enlarged view of ellipse R and its vicinity shown in FIG. 1.

Referring first to FIG. 3, air discharge opening 20 is provided with a louver 21 including one or more blades. Temperature sensor 29 is arranged on part of a blade of louver 21. In FIG. 3, an arrow A3 indicates a flow of air delivered from the inside of casing 10A (see FIG. 1) to the outside. A filter 22 is provided upstream of louver 21 in this flow. Since an ambient temperature in fixing device 30 becomes relatively high, filter 22 is formed of a material resistant to damage such as melting due to the air of relatively high temperature flowing from fixing device 30. The air indicated by arrow A3 passes through filter 22 and a region provided with louver 21, and is delivered to the outside of casing 10A.

In FIG. 4, the blades of louver 21 are rotated to move from the state shown in FIG. 3, to close air discharge opening 20. As a result, even if the air is delivered by fan 160 as indicated by an arrow A4, the path of the air to the outside of casing 10A is interrupted (or blocked).

During the image forming operation in printer 10, louver 21 is basically in the state shown in FIG. 3. When fixing roller 31 reaches a high temperature, louver 21 is closed to reduce the opening degree of air discharge opening 20, as shown in FIG. 4. As a result, emissions of ozone, toner dust and the like, as well as UFPs and the like considered to be generated in casing 10A at a high temperature, to the outside of casing 10A is avoided, and condensation of the UPFs in casing 10A and adhesion of the UFPs to an inner wall of casing 10A are facilitated.

When the opening degree of air discharge opening 20 is reduced on condition that fixing roller 31 reaches a high temperature as described above, a situation is envisioned where the temperature in casing 10A increases. Thus, in order to be able to efficiently release heat in casing 10A to the outside even when air discharge opening 20 has a low opening degree, louver 21 is preferably made of a material having a high thermal conductivity such as metal including iron, copper, aluminum, or their alloys.

<Control of Opening/Closing of Louver>

Figure 5:
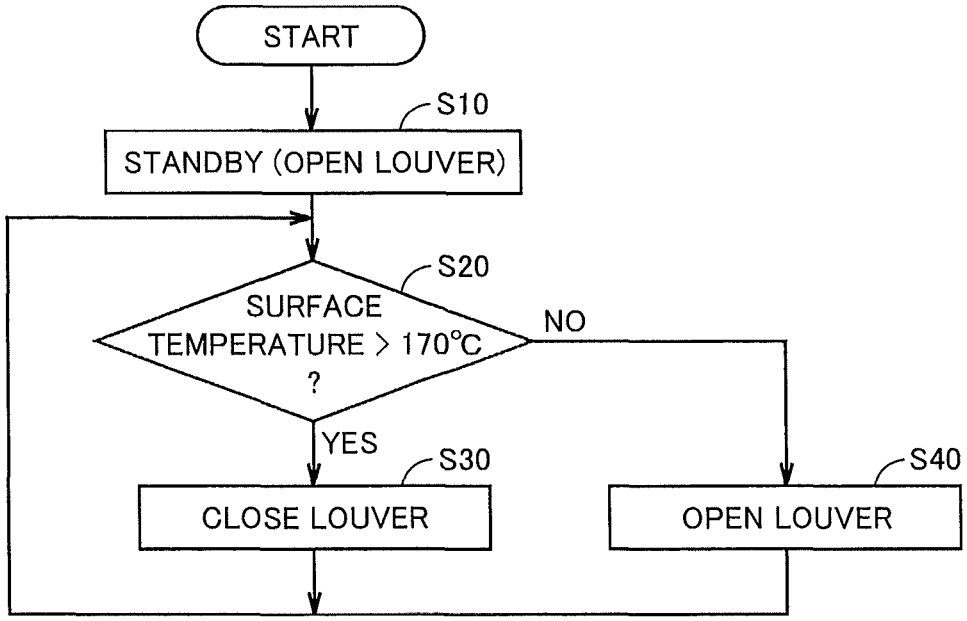
FIG. 5 is a flowchart of a process executed during an image forming operation in the printer shown in FIG. 1.

Referring to FIG. 5, control of opening/closing of louver 21 is described. FIG. 5 is a flowchart of the process of controlling opening/closing of louver 21 executed by CPU 101 during the image forming operation in printer 10.

Referring to FIG. 5, upon turn-on of printer 10, in step S10, CPU 101 drives motor for louver 150 so that louver 21 is in the state such as shown in FIG. 3, and proceeds the control process to step S20.

In step S20, CPU 101 determines whether or not a surface temperature of fixing roller 31 derived based on a detected temperature from temperature sensor 32 (hereinafter referred to simply as "surface temperature of fixing roller 31") has exceeded 170° C. If it is determined that the surface temperature has exceeded 170° C. (YES in step S30), CPU 101 proceeds the control process to step S30. On the other hand, if it is determined that the surface temperature is equal to or lower than 170° C. (NO in step S30), CPU 101 proceeds the control process to step S40.

In this embodiment, the surface temperature of fixing roller 31 may be derived based on the temperature in the vicinity of fixing roller 31 detected by temperature sensor 32. Specifically, the surface temperature of fixing roller 31 is derived by calculating the product of the temperature in the vicinity of fixing roller 31 and a correction coefficient, for example. The surface temperature of fixing roller 31 may be obtained by detecting the temperature in the vicinity of the surface of fixing roller 31 using a noncontact sensor, for example.

In step S40, CPU 101 drives motor for louver 150 so that louver 21 is in the state where the air flows through opening 20 (see FIG. 3), and returns the control process to step S20. In step S40, CPU 101 checks the state of louver 21 at that point in time. Then, if louver 21 is already in the state shown in FIG. 3, CPU 101 does not drive motor for louver 150 in step S40 and returns the control process to step S20.

In step S30, on the other hand, CPU 101 drives motor for louver 150 so that louver 21 is in the state where the air is less likely to flow through opening 20 than in the state shown in FIG. 3 (see FIG. 4), and returns the control process to step S20. In step S30, CPU 101 checks the state of louver 21 at that point in time. Then, if louver 21 is already in the state shown in FIG. 4, CPU 101 does not drive motor for louver 150 in step S30 and returns the control process to step S20.

In the embodiment described above, when the surface temperature of fixing roller 31 is equal to or lower than 170° C., louver 21 is controlled to be in the state shown in FIG. 3. When the surface temperature exceeds 170° C., on the other hand, louver 21 is controlled to be in the state where the air is less likely to flow through opening 20 than in the state shown in FIG. 3 (see FIG. 4), that is, a state where the opening degree of air discharge opening 20 is reduced compared to that when the surface temperature is equal to or lower than 170° C.

<Example of Control Result>

Figure 6A:
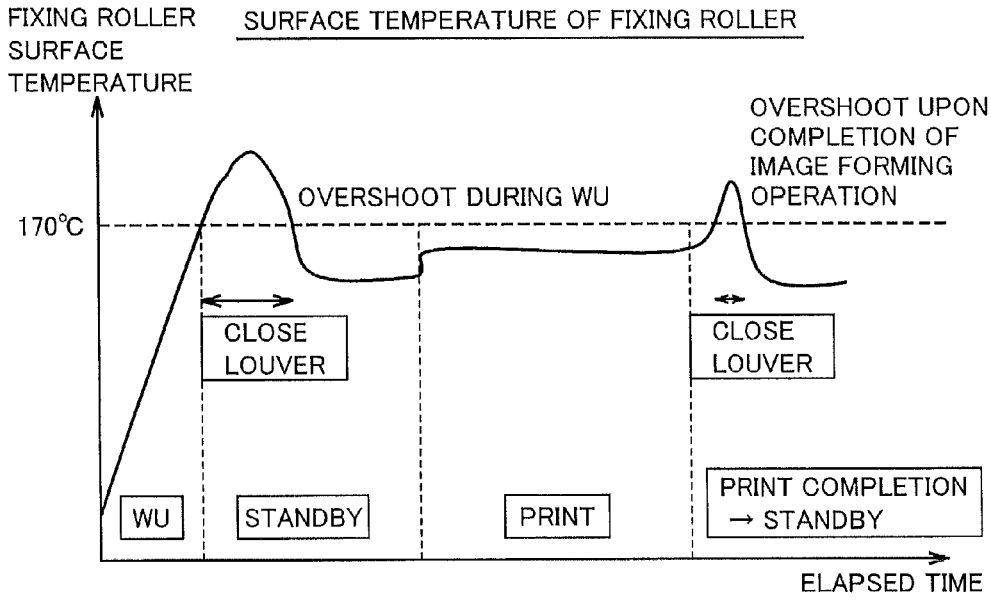
FIG. 6A is a diagram for explaining an effect of controlling opening/closing of the louver in the printer shown in FIG. 1.
Figure 6B:
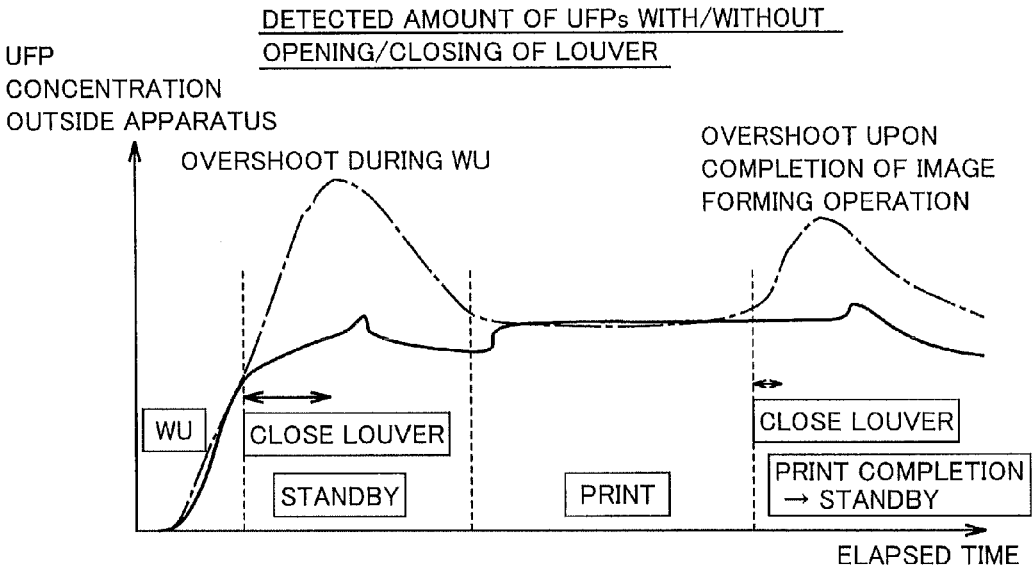
FIG. 6B is a diagram for explaining an effect of controlling opening/closing of the louver in the printer shown in FIG. 1.

FIGS. 6A and 6B are diagrams for explaining an effect of the control of opening/closing of louver 21 in printer 10. FIG. 6A shows a temporal variation in temperature of fixing roller 31. FIG. 6B shows a temporal variation in UFP concentration outside of casing 10A. In each of FIGS. 6A and 6B, a horizontal axis represents time that has elapsed since printer 10 was turned on.

Referring to FIG. 6A, after turn-on of printer 10, a warm-up operation is performed ("WU" in FIG. 6A). During this period of time, fixing roller 31 is heated, causing increase in surface temperature of fixing roller 31 as well.

At the start of the warm-up operation, louver 21 is controlled to be in the state shown in FIG. 3.

Then, when the surface temperature of fixing roller 31 exceeds 170° C., louver 21 is closed to change the state of louver 21 from that shown in FIG. 3 to that shown in FIG. 4. During the state change of louver 21, printer 10 makes a transition to a standby state. Then, when the surface temperature of fixing roller 31 becomes equal to or lower than 170° C., louver 21 is opened again. That is, louver 21 is controlled to make a transition to the state shown in FIG. 3.

When the image forming operation is performed ("PRINT" in FIG. 6A) and completed in printer 10, the surface temperature of fixing roller 31 exceeds 170° C. again in FIG. 6A. Louver 21 is closed accordingly. Then, when the surface temperature of fixing roller 31 becomes equal to or lower than 170° C., louver 21 is opened again.

In FIG. 6B, a solid line indicates a detected amount of UFPs when the control described with reference to FIG. 5 was performed. On the other hand, a chain-dotted line in FIG. 6B indicates a detected amount of UFPs when louver 21 was kept in the opened state (see FIG. 3) regardless of the surface temperature of fixing roller 31.

The detected concentration of UFPs indicated by the chain-dotted line in FIG. 6B varies in a manner substantially similar to that of the temperature variation shown in FIG. 6A. That is, the detected concentration of UFPs increases as the surface temperature of fixing roller 31 increases. Particularly, (during standby) after completion of the warm-up and after completion of the image forming operation in printer 10, an overshoot (abrupt increase) is temporarily seen.

On the other hand, as indicated by the solid line in FIG. 6B, the overshoot seen (during standby) after completion of the warm-up and after completion of the image forming operation in printer 10 is eliminated when the control in this embodiment (FIG. 5) is performed. Specifically, although the UFP concentration exhibits increase in accordance with the behavior of the surface temperature of fixing roller 31 while louver 21 is opened, the increase stops when louver 21 is closed.

In view of the above, an overshoot in UFP concentration can be avoided by controlling opening/closing of louver 21 in accordance with the surface temperature of fixing roller 31 in this embodiment. In printer 10, toner and ozone not emitted to the outside of casing 10A adheres to a bottom surface and inner wall of casing 10A. As a result, an amount of these emissions to the outside of casing 10A can be reduced.

<Modification (1)>

Printer 10 in a modification (1) can have a configuration similar to that of printer 10 described above, except for the following features described below. The difference of printer 10 in the modification (1) from above-described printer 10 is described below.

During the control of opening/closing of louver 21 described with reference to FIG. 5, louver 21 is closed when the surface temperature of fixing roller 31 exceeds 170° C. and opened when the surface temperature becomes equal to or lower than 170° C. In this case, if the surface temperature of fixing roller 31 varies at short intervals in the vicinity of 170° C., a situation is envisioned where louver 21 is constantly switched between the opened state and the closed state.

In order to avoid such situation, during the control of opening/closing of louver 21, the states of louver 21 may be switched so that louver 21 is closed when the surface temperature of fixing roller 31 exceeds a first temperature and louver 21 is opened when the surface temperature becomes equal to or lower than a second temperature lower than the first temperature. The control of opening/closing of louver 21 employing the first and second temperatures can handle a time lag between the variation in detected temperature of temperature sensor 32 and the variation in the detected amount of UFPs outside of casing 10A.

During the opening/closing control in the modification (1), if switching from the opened state to the closed state and switching from the closed state to the opened state of fixing roller 31 are performed at the same temperature, that is, if the first temperature and the second temperature are identical to each other, a situation is envisioned where louver 21 is constantly switched between the opened state and the closed state. In order to avoid the constant switching, CPU 101 may switch between the opening and closing of fixing roller 31 by acquiring temperature detected by temperature sensor 32 at regular time intervals, or by utilizing an average value of a temperature detected by temperature sensor 32 after a certain period of time.

<Modification (2)>

Printer 10 in a modification (2) can have a configuration similar to that of above-described printer 10, except for the following features described below. The difference of printer 10 in the modification (2) from above-described printer 10 is described below.

In printer 10, air discharge opening 20 is closed when fixing roller 31 reaches a high temperature. In order to suppress temperature increase in casing 10A resulting from such control, printer 10 may further include another fan separate from fan 160.

Figure 7:
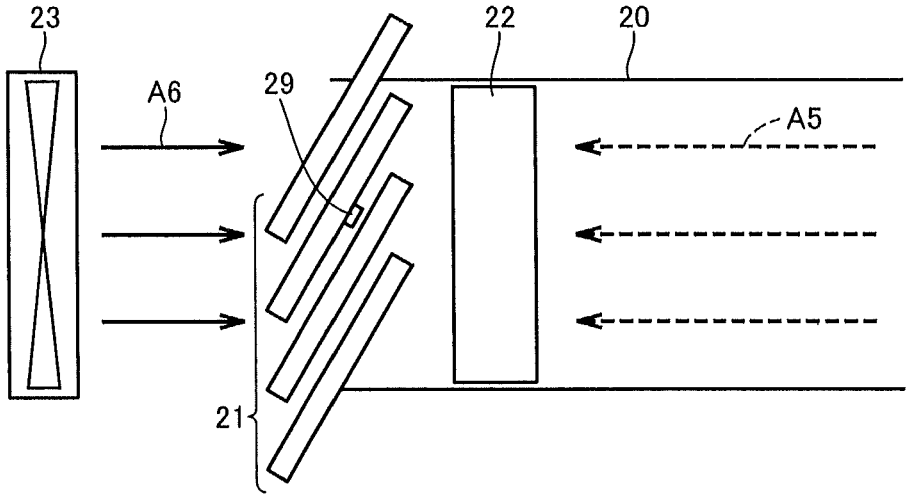
FIG. 7 is a diagram for explaining a manner in which a casing is cooled by a fan provided in a modification of the printer shown in FIG. 1.
Figure 8:
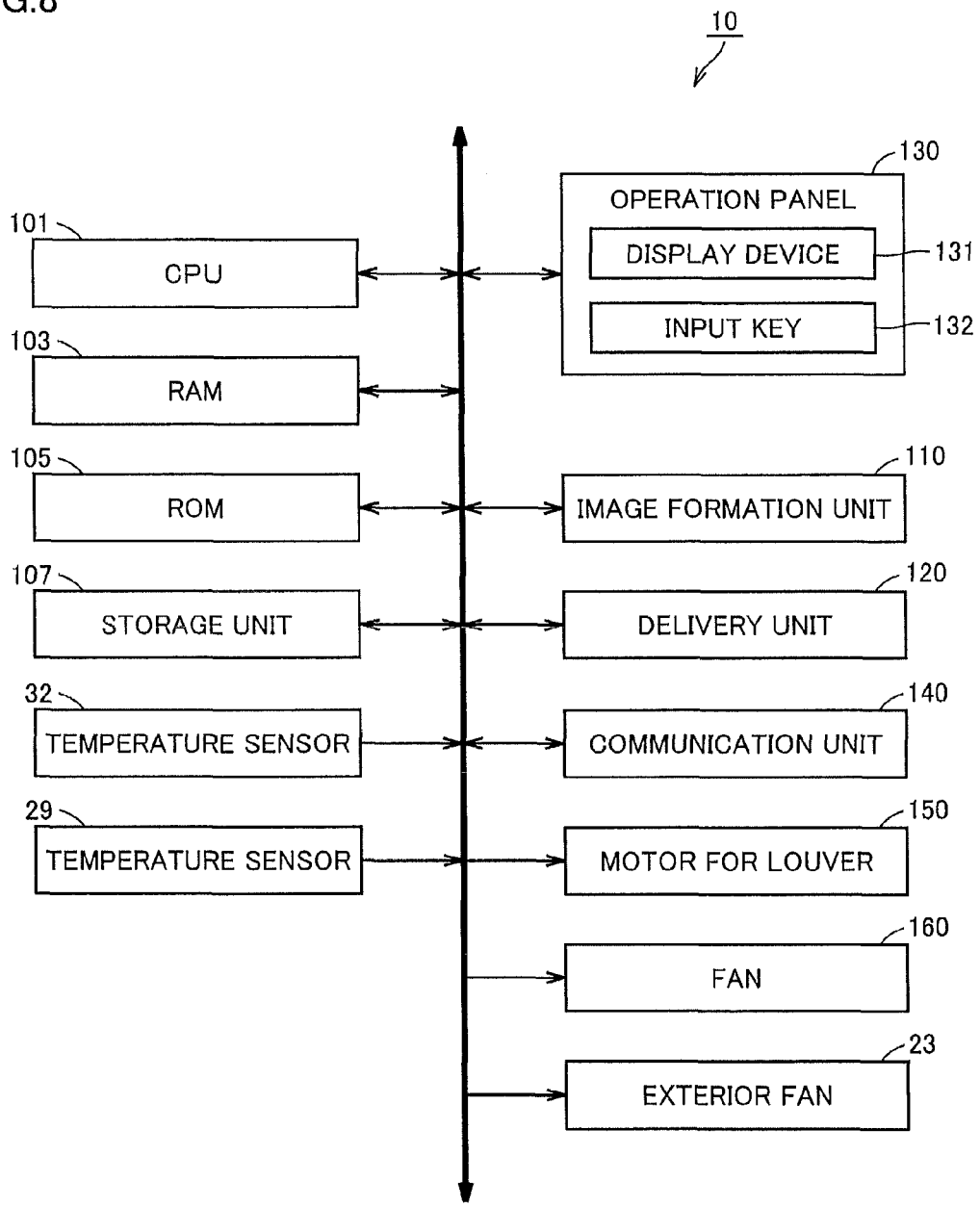
FIG. 8 is a diagram showing a hardware configuration of the modification of the printer shown in FIG. 1.

FIG. 7 is a diagram for explaining a manner in which casing 10A is cooled by another fan separate from fan 160. FIG. 8 is a diagram showing a hardware configuration of printer 10 in the modification (2).

Referring to FIG. 7, in the modification (2), a separately provided exterior fan 23 cools louver 21 provided at air discharge opening 20 from outside of casing 10A. Arrow A5 indicates a path of air delivered from the inside of casing 10A to the outside. Arrow A6 indicates a flow of air delivered from the exterior fan 23 to the louver 21. If louver 21 is made of a material having a high thermal conductivity as described above, the interior of casing 10A of printer 10 in this modification is efficiently cooled by exterior fan 23 even while louver 21 is closed. In addition, such cooling can facilitate condensation of UPFs in casing 10A and adhesion of UFPs to the inner wall of casing 10A.

Referring to FIG. 8, the operation of exterior fan 23 is controlled by CPU 101. CPU 101 causes exterior fan 23 to rotate while printer 10 performs the image forming operation and while louver 21 is closed in step S30 of FIG. 5, for example.

<Modification (3)>

Printer 10 in a modification (3) can have a configuration similar to that of above-described printer 10, except for the following features described below. The difference of printer 10 in the modification (3) from above-described printer 10 is described below.

During the control of opening/closing of louver 21 in the modification (3), louver 21 is opened even when the surface temperature of fixing roller 31 exceeds 170° C., if a particular condition is satisfied.

The particular condition in the modification (3) is that temperature in the vicinity of air discharge opening 20 (hereinafter also referred to as opening-vicinity temperature in casing 10A) exceeds a particular temperature. That is, in the modification (3), louver 21 is opened even when the surface temperature of fixing roller 31 exceeds 170° C., if the temperature in the vicinity of air discharge opening 20 exceeds a particular temperature.

Figure 9:
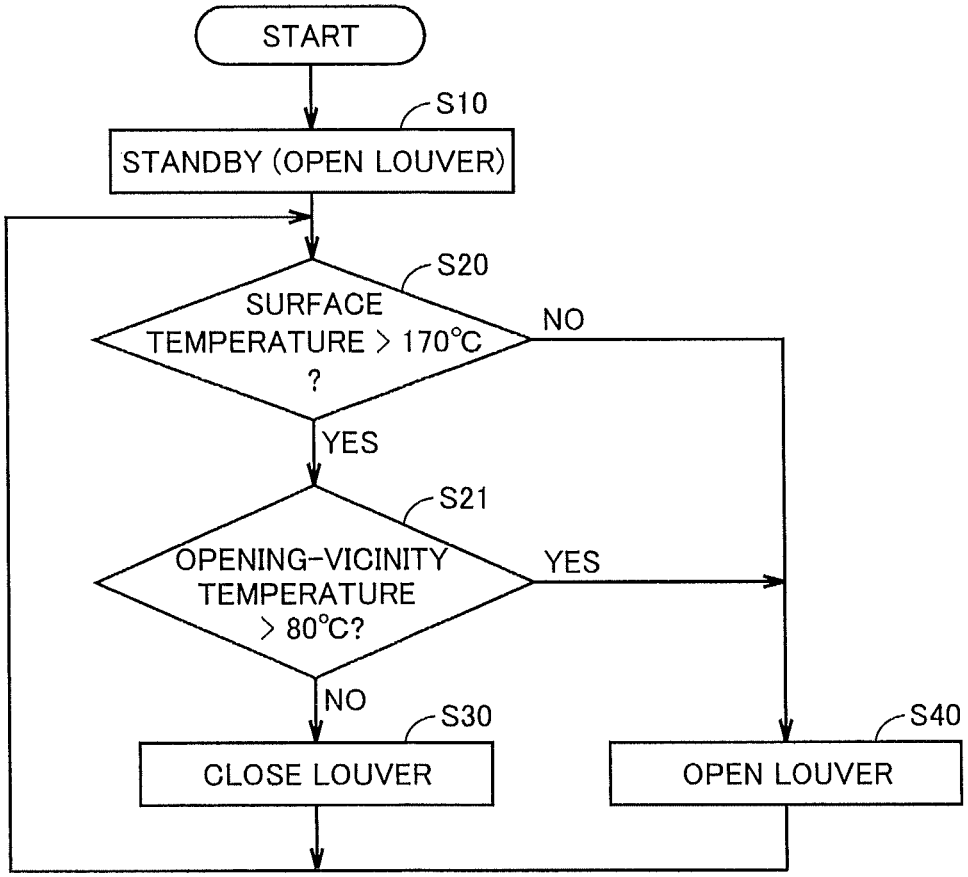
FIG. 9 is a flowchart of a process of controlling opening/closing of the louver in a modification of the printer shown in FIG. 1.

FIG. 9 is a flowchart of the process of controlling opening/closing of louver 21 in this modification.

Referring to FIG. 9, in the opening/closing process in this modification, if it is determined in step S20 that the surface temperature of fixing roller 31 has exceeded 170° C., CPU 101 proceeds the control process to step S21.

In step S21, CPU 101 determines whether or not the opening-vicinity temperature has exceeded 80° C. Specifically, in step S21, CPU 101 determines whether or not a detected temperature from temperature sensor 29 (see FIG. 3) has exceeded 80° C. If it is determined that the detected temperature from temperature sensor 29 has exceeded 80° C., CPU 101 proceeds the control process to step S40. If it is determined that the detected temperature is equal to or lower than 80° C., CPU 101 proceeds the control process to step S30.

Then, CPU 101 closes louver 21 in step S30, and opens louver 21 in step S40.

As such, in the modification (3), louver 21 is opened even when the surface temperature of fixing roller 31 exceeds 170° C., if the detected temperature from temperature sensor 29 exceeds 80° C.

<Modification (4)>

Printer 10 in a modification (4) can have a configuration similar to that of above-described printer 10, except for the following features described below. The difference of printer 10 in the modification (4) from above-described printer 10 is described below.

During the control of opening/closing of louver 21 in the modification (4), louver 21 is opened even when the surface temperature of fixing roller 31 exceeds 170° C., if a particular condition is satisfied.

The particular condition in the modification (4) is that the number of recording media (sheets) successively subjected to image formation (printing) in printer 10 exceeds a particular number. That is, in the modification (4), louver 21 is opened even when the surface temperature of fixing roller 31 exceeds 170° C., if the number of recording media (sheets) successively subjected to image formation (printing) in printer 10 exceeds a particular number.

Figure 10:
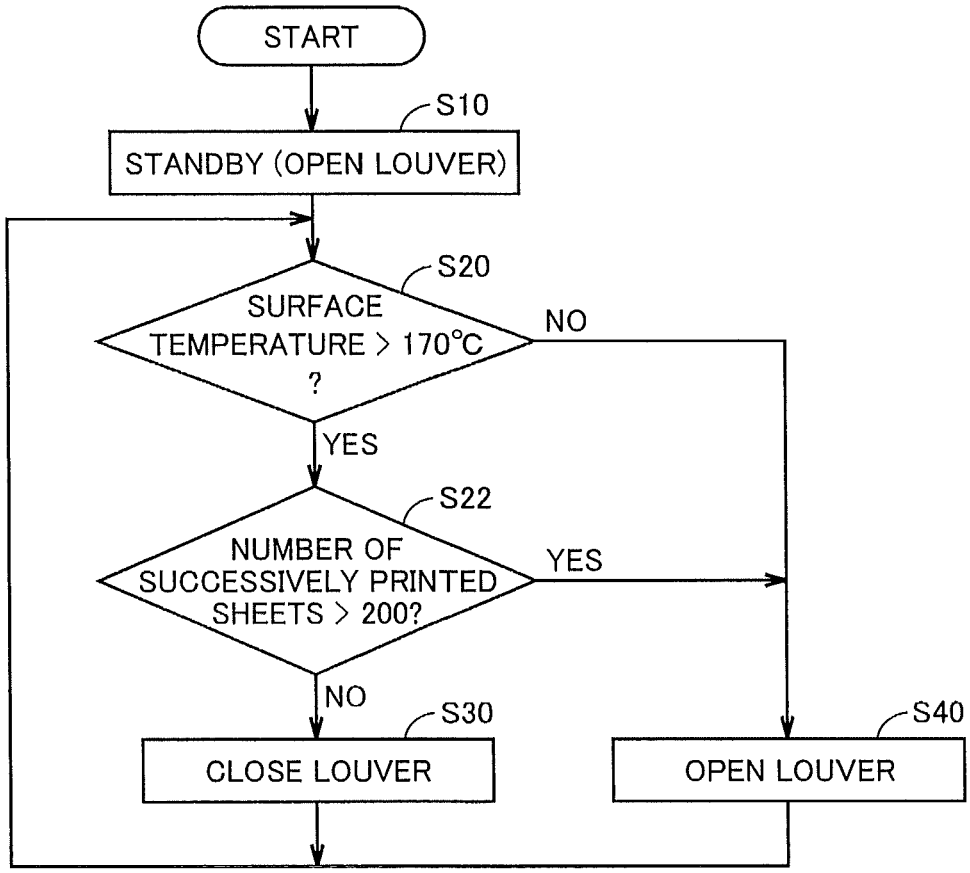
FIG. 10 is a flowchart of a process of controlling opening/closing of the louver in a modification of the printer shown in FIG. 1.

FIG. 10 is a flowchart of the process of controlling opening/closing of louver 21 in this modification.

Referring to FIG. 10, in the opening/closing process in the modification (4), if it is determined in step S20 that the surface temperature of fixing roller 31 has exceeded 170° C., CPU 101 proceeds the control process to step S22.

In step S22, CPU 101 determines whether or not the number of sheets successively subjected to printing in printer 10 has exceeded 200. CPU 101 implements the determination in step S22 by acquiring, from image formation unit 110, the number of sheets that have been successively subjected to printing that is counted in image formation unit 110, for example. If it is determined that the number of successively printed sheets has exceeded 200, CPU 101 proceeds the control process to step S40. If it is determined that the number is equal to or lower than 200, CPU 101 proceeds the control process to step S30.

Then, CPU 101 closes louver 21 in step S30, and opens louver 21 in step S40.

As such, in the modification (4), louver 21 is opened even when the surface temperature of fixing roller 31 exceeds 170° C., if the number of successively printed sheets exceeds 200. It is noted that "successively" means that a printing operation on the next sheet is started before a certain period of time has elapsed since a printing operation on a previous sheet in printer 10, for example.

<Modification (5)>

Printer 10 in a modification (5) can have a configuration similar to that of above-described printer 10, except for the following features described below. The difference of printer 10 in the modification (5) from above-described printer 10 described above is described below.

During the control of opening/closing of louver 21 in the modification (5), louver 21 is opened even when the surface temperature of fixing roller 31 exceeds 170° C., if a particular condition is satisfied.

The particular condition in the modification (5) is that a state where louver 21 is closed due to the surface temperature exceeding 170° C. continues for a prescribed period of time or longer. That is, in the modification (5), louver 21 is opened even when the surface temperature of fixing roller 31 exceeds 170° C., if louver 21 is closed due to the surface temperature of fixing roller 31 exceeding 170° C. and such state continues for a prescribed period of time or longer in printer 10.

Figure 11:
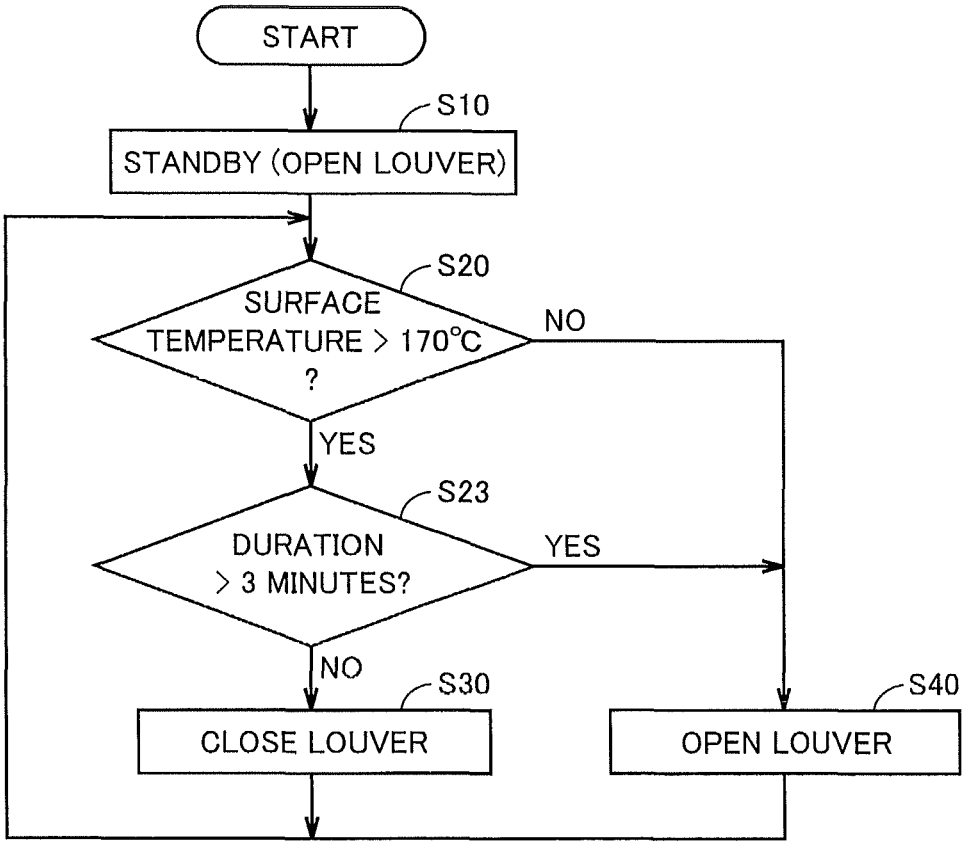
FIG. 11 is a flowchart of a process of controlling opening/closing of the louver in a modification of the printer shown in FIG. 1.

FIG. 11 is a flowchart of the process of controlling opening/closing of louver 21 in the modification (5).

Referring to FIG. 11, in the opening/closing process in the modification (5), if it is determined in step S20 that the surface temperature of fixing roller 31 has exceeded 170° C., CPU 101 proceeds the control process to step S23.

In step S23, CPU 101 determines whether or not a period of time during which louver 21 is closed in step S30 (hereinafter referred to as "duration") in printer 10 has exceeded 3 minutes. If it is determined that the duration has exceeded 3 minutes, CPU 101 proceeds the control process to step S40. If it is determined that the duration is equal to or shorter than 3 minutes, CPU 101 proceeds the control process to step S30.

Then, CPU 101 closes louver 21 in step S30, and opens louver 21 in step S40.

As such, in the modification (5), louver 21 is opened even when the surface temperature of fixing roller 31 exceeds 170° C., if the above "duration" exceeds 3 minutes.

<Other Modifications>

According to the embodiment and its modifications described above, opening/closing of louver 21 is controlled based on the surface temperature of fixing roller 31. As such, in printer 10, emissions of dust including UFPs, ozone and toner to the outside of casing 10A by an air current in casing 10A can be suppressed without requiring increase in structural complexity and size of the apparatus.

In the embodiment and its modifications, the closed state of louver 21 shown in FIG. 4 is only required to have an opening degree of air discharge opening 20 lower than at least the opening degree of the opened state shown in FIG. 3. Here, the opening degree refers to a degree to which the air passes through air discharge opening 20. The higher the opening degree, the easier for the air to pass through air discharge opening 20.

In printer 10, when the surface temperature of fixing roller 31 exceeds 170° C., louver 21 is displaced so that air discharge opening 20 has a relatively low opening degree. In this case, in order to more reliably avoid discharge of air and the like from the inside of casing 10A to the outside, louver 21 is preferably displaced so that air discharge opening 20 has an opening degree of zero, that is, until a rotational position to close air discharge opening 20.

Moreover, in the embodiment and its modifications described above, the operation of fan 160 is also preferably suspended during the period of time during which louver 21 is closed in the process of step S30.

While a black-and-white printer has been illustrated as an example of the image forming apparatus in the embodiment and its modifications described above, the image forming apparatus may be an apparatus of another type as long as it includes a fixing unit.

For example, the image forming apparatus may be a four-cycle type image forming apparatus including four developing devices of different colors around a rotation axis of photoreceptor 14, which are successively caused to face an electrostatic latent image carrier to produce a full-color image.

Alternatively, the image forming apparatus may be a complex machine further having a facsimile functionality and scan functionality.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus having an outline surrounded by a casing, for forming an image on a recording medium, said casing having an opening, comprising:

a fixing unit configured to fix an image formed on the recording medium, said fixing unit including a heating fixing member;

a control unit configured to control an opening degree of said opening; and a first detection unit configured to detect temperature of a surface of or in the vicinity of said heating fixing member, said control unit being configured to control the opening degree of said opening based on the temperature detected by said first detection unit, wherein, in a case where the temperature detected by said first detection unit exceeds a first set value, said control unit is configured to reduce the opening degree of said opening compared to the opening degree when the temperature is equal to or lower than said first set value, and after the opening degree of said opening has been reduced due to the temperature detected by said first detection unit exceeding said first set value, in a case where the temperature detected by said first detection unit reaches a second set value or lower which is a value equal to or lower than said first set value, said control unit is configured to cancel the reduction of the opening degree of said opening.

2. The image forming apparatus according to claim 1, wherein said control unit is configured not to reduce the opening degree of said opening even in a case where the temperature detected by said first detection unit exceeds said first set value, when a particular condition is satisfied.

3. The image forming apparatus according to claim 2, further comprising a second detection unit configured to detect temperature in the vicinity of said opening, wherein said particular condition is that the temperature detected by said second detection unit exceeds a particular temperature.

4. The image forming apparatus according to claim 2, wherein said particular condition is set based on a number of recording media on which an image is formed by said image formation unit.

5. The image forming apparatus according to claim 2, wherein said particular condition is set based on a period of time during which said control unit continues the reduction of the opening degree of said opening.

6. An image forming apparatus having an outline surrounded by a casing, for forming an image on a recording medium, said casing having an opening comprising:

a fixing unit configured to fix an image formed on the recording medium, said fixing unit including a heating fixing member;

a control unit configured to control an opening degree of said opening; and a first detection unit configured to detect temperature of a surface of or in the vicinity of said heating fixing member, said control unit being configured to control the opening degree of said opening based on the temperature detected by said first detection unit, wherein said control unit is configured to reduce the opening degree of said opening until said opening is closed.

7. An image forming apparatus having an outline surrounded by a casing, for forming an image on a recording medium, said casing having an opening, comprising:

a fixing unit configured to fix an image formed on the recording medium, said fixing unit including a heating fixing member;

a control unit configured to control an opening degree of said opening;

a first detection unit configured to detect temperature of a surface of or in the vicinity of said heating fixing member; and a member for varying the opening degree of said opening, said control unit being configured to control the opening degree of said opening based on the temperature detected by said first detection unit, wherein:

said control unit is configured to control the opening degree of said opening by displacing said member; and said member contains metal.

8. A method of controlling an image forming apparatus having an outline surrounded by a casing, for forming an image on a recording medium, said image forming apparatus including a fixing unit configured to fix an image formed on the recording medium and a control unit configured to control operations of said image forming apparatus, said casing having an opening, said fixing unit including a heating fixing member, the method comprising the steps of:

detecting, by said image forming apparatus, a temperature of a surface of or in the vicinity of said heating fixing member during an image forming operation; and controlling, by said image forming apparatus, an opening degree of said opening based on the temperature of a surface of or in the vicinity of said heating fixing member, wherein, in a case where the temperature detected exceeds a first set value, said image forming apparatus is configured to reduce the opening degree of said opening compared to the opening degree when the temperature is equal to or lower than said first set value, and after the opening degree of said opening has been reduced due to the temperature detected exceeding said first set value, in a case where the temperature detected reaches a second set value or lower which is a value equal to or lower than said first set value, said image forming apparatus is configured to cancel the reduction of the opening degree of said opening.

* * * * *